US006308357B1

(12) United States Patent
Maier et al.

(10) Patent No.: US 6,308,357 B1
(45) Date of Patent: Oct. 30, 2001

(54) BRIDGE

(75) Inventors: Peter Maier, Rielasingen; Branislav Kmet, Gottmadingen, both of (DE)

(73) Assignee: Peter Maier Leichtbau GmbH (DE)

( * ) Notice: Subject to any disclaimer, the term of this patent is extended or adjusted under 35 U.S.C. 154(b) by 0 days.

(21) Appl. No.: 09/435,298

(22) Filed: Nov. 5, 1999

(30) Foreign Application Priority Data

Nov. 6, 1998 (DE) ..... 198 51 202

(51) Int. Cl.[7] ..... E01D 19/00
(52) U.S. Cl. ..... 14/13; 14/71.1
(58) Field of Search ..... 14/2.4, 3, 4, 7, 14/13, 71.1

(56) References Cited

U.S. PATENT DOCUMENTS

| | | | | |
|---|---|---|---|---|
| 187,513 | * | 2/1877 | Colby | 14/13 |
| 452,274 | * | 5/1891 | Keller | 14/13 |
| 4,003,473 | * | 1/1977 | Ryan | 14/71.1 |
| 4,253,210 | * | 3/1981 | Racicot | 14/13 |
| 5,008,967 | * | 4/1991 | Barrios et al. | 14/7 |
| 5,065,467 | * | 11/1991 | Forsyth | 14/4 |
| 5,924,152 | * | 7/1999 | Maier | 14/2.4 |
| 6,009,586 | * | 1/2000 | Hawkes et al. | 14/4 |
| 6,182,319 | * | 2/2001 | Maier et al. | 14/4 |

* cited by examiner

*Primary Examiner*—Thomas B. Will
*Assistant Examiner*—Raymond W. Addie
(74) *Attorney, Agent, or Firm*—Bachman & LaPointe, P.C.

(57) ABSTRACT

A bridge for walking on is made from surfaces and from a handrail assigned to the surfaces. The handrail includes hollow section segments which have at least one longitudinal groove for connecting to struts, walls or the like.

6 Claims, 3 Drawing Sheets

BRIDGE

The present invention relates to a bridge made from surfaces for walking on and a handrail assigned to the surfaces for walking on via struts, walls or the like.

Such a device is disclosed, for example, in DE 196 25 819.7 A1. The essential feature of this invention is that virtually the entire device can be produced by employing the building-block principle. It essentially comprises aluminum sections which can be produced easily and cost-effectively.

It is the object of the present invention further to improve this device for walking on which is disclosed in DE 196 25 819 A1, in particular to increase the stability and facilitate production.

This object is achieved by virtue of the fact that the handrail comprises hollow section segments which have at least one longitudinal groove for connecting to the struts, walls or the like.

Because of its shape, the hollow section has the advantage that it has a very high stability and, in particular, bending strength. This gives the bridge a high degree of steadiness.

The longitudinal groove has the advantage that connection to the struts and/or walls can be substantially facilitated. It is provided for this purpose that the longitudinal groove is of undercut construction so that it can hold appropriate sliding blocks. The sliding blocks have the advantage, in turn, that they can be displaced in the longitudinal groove so that a connection between the hollow section segments and the struts and/or walls can be made at any desired point.

The hollow section is preferably an extruded aluminum section, it being possible to cut the appropriate hollow section segments from this aluminum section depending on the length desired. The production of such extruded aluminum sections is extremely cost-effective.

A plurality of symmetrically distributed grooves are preferably located on the circumference of the hollow section. These grooves permit the hollow section segment to be applied and used in a versatile fashion.

The hollow section is preferably shaped with a round cross section. Optimum stability is achieved thereby.

The idea is not only for the handrails to be formed from such hollow section segments, but also to underlay the very surfaces for walking on with hollow section segments which are then connected again at the side to corresponding hollow section segments as posts. This again increases the stability once more.

It is also possible, in addition, to configure a bridge with hollow section segments as beams which are provided opposite the handrails below the surface for walking on. This permits a desired bridge to be assembled using the building-block principle.

In order for it to be possible to interconnect the individual hollow section segments, joint pieces are provided which can be connected in a jointed fashion to the hollow section segments in order also to be able to take account of a different alignment of hollow sections.

Further advantages, features and details of the invention emerge from the following description of preferred exemplary embodiments, and with the aid of the drawing, in which.

Figure 1:
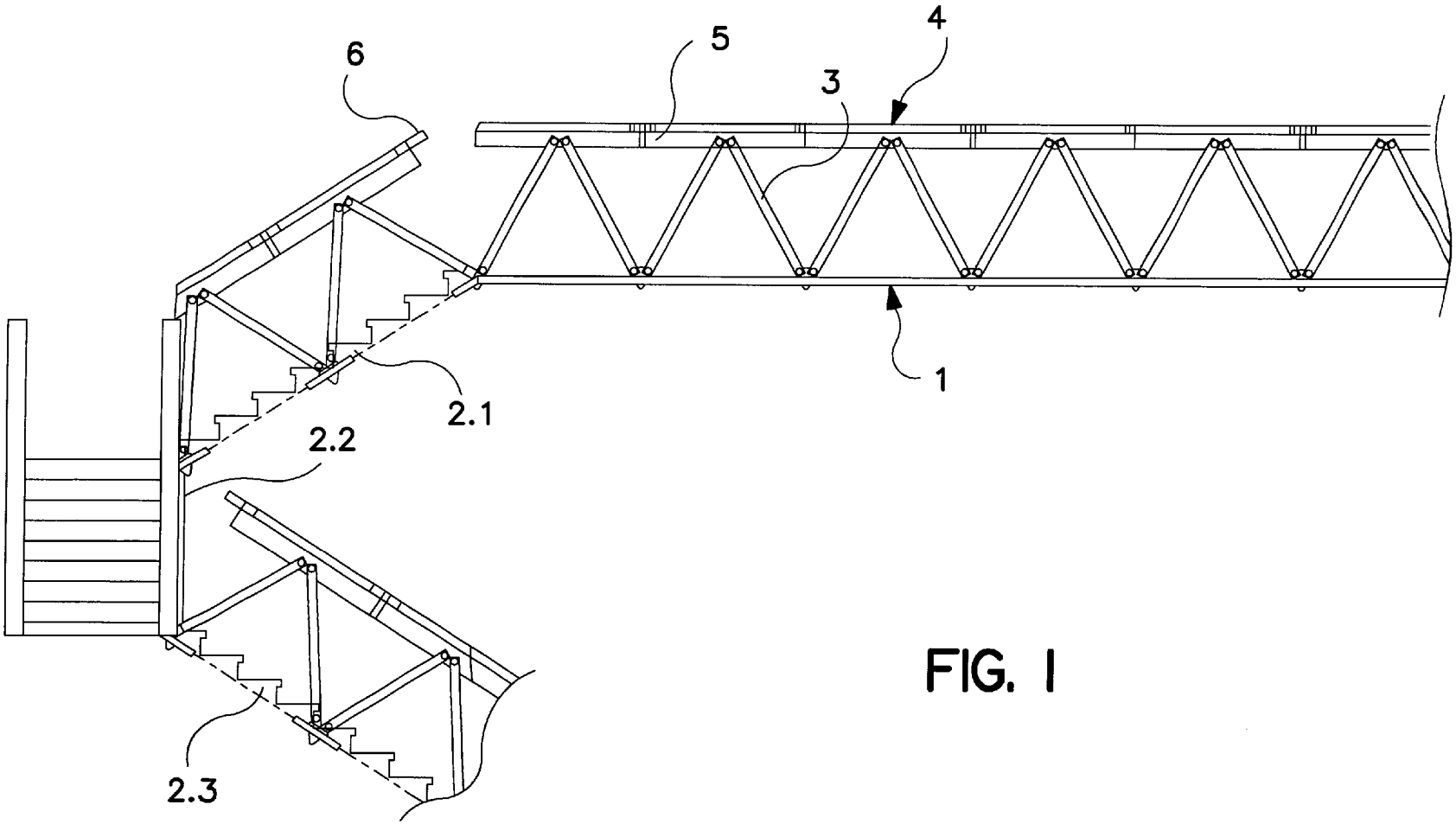
FIG. 1 shows a partial representation of a bridge according to the invention.

In accordance with FIG. 1, a bridge has surfaces for walking on, planks 1 and stairs 2.1 to 2.3 being indicated as surfaces for walking on. Via struts 3, the surfaces for walking on are assigned handrails 4 which comprise individual hollow section segments 5. Individual hollow section segments 5 are interconnected by joint pieces 6.

Figure 2:
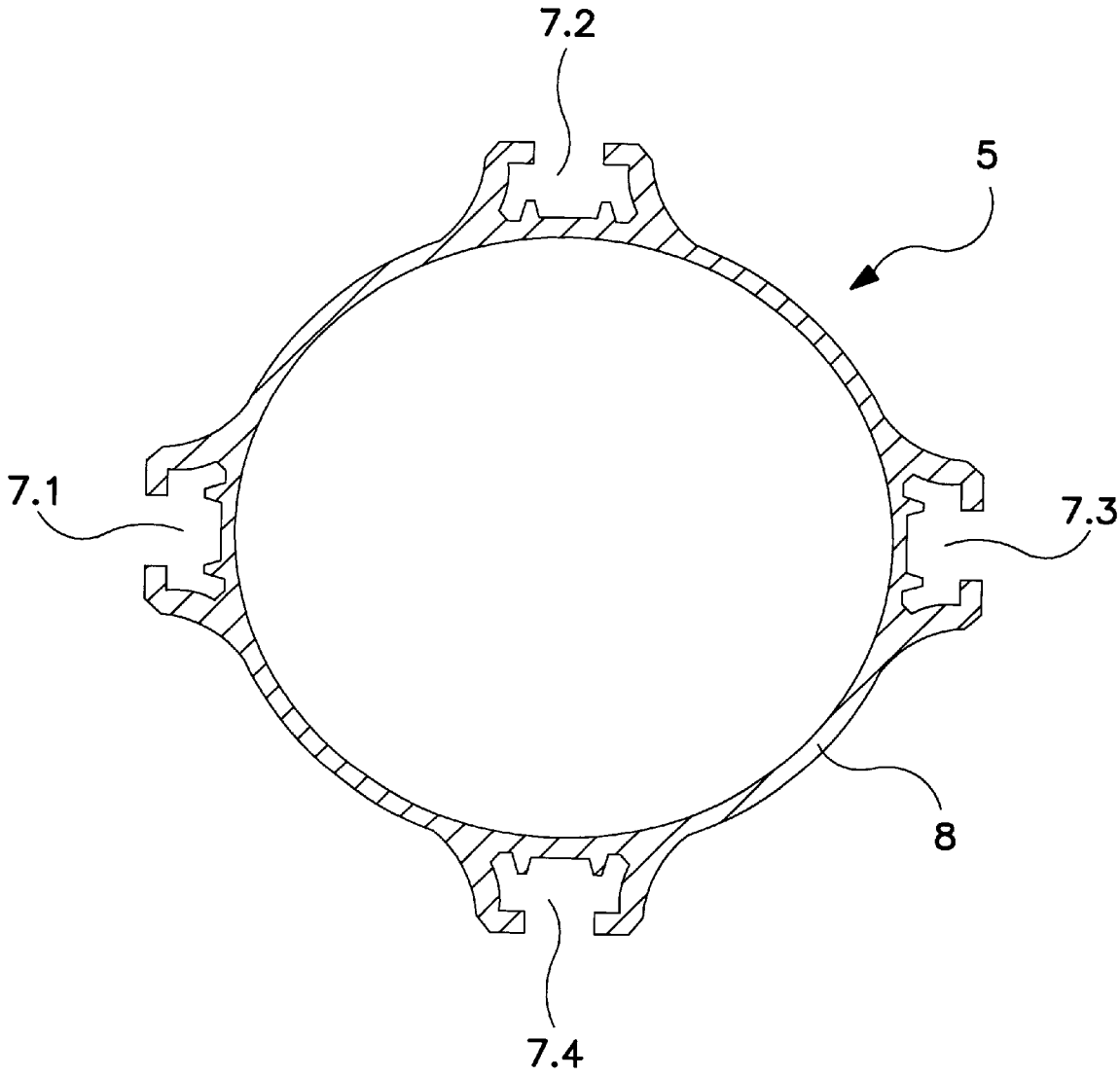
FIG. 2 shows a cross section through a hollow section according to the invention.

In accordance with FIG. 2, each hollow section segment 5 is constructed with a round cross section and has symmetrically distributed grooves 7.1 to 7.4 on its lateral surface 8. The grooves 7.1 to 7.4 are configured in this case such that they serve to hold T sliding blocks, for example, that is to say they are of undercut construction. Consequently, it is very easy to assemble, or easy to connect hollow section segments 5 using the struts 3, for example.

Figure 3:
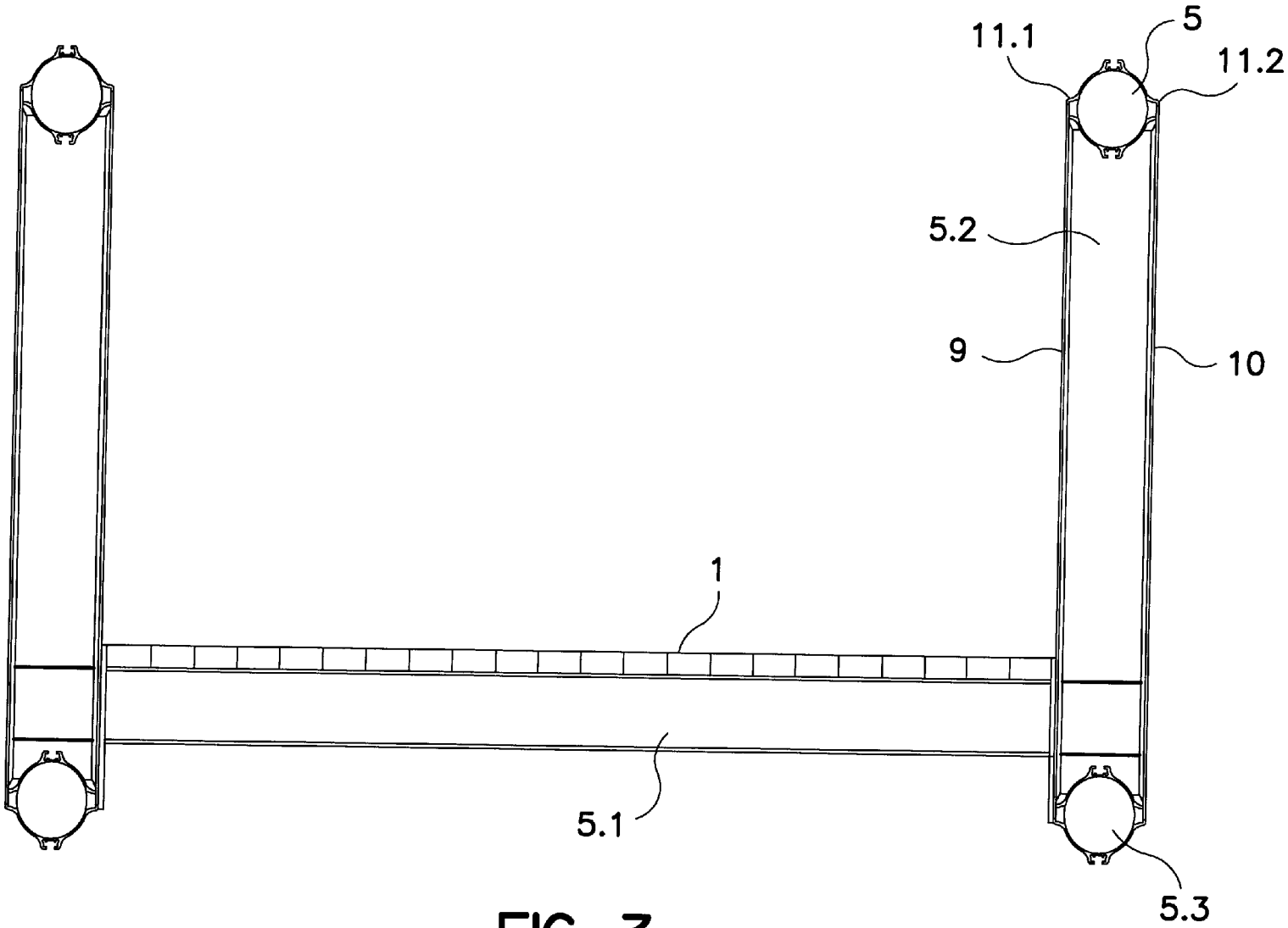
FIG. 3 shows a cross section through a further exemplary embodiment of a bridge.

A solid-web section bridge is shown in FIG. 3. In the case of this bridge, the planks 1 are underlaid by a wider hollow section segment 5.1 which comprises the same extruded hollow sections as the hollow section segments 5 of the handrail 4.

By contrast, the handrail 5 is faced with an inner wall 9 and an outer wall 10, the connection between the inner wall 9 or outer wall 10 and the hollow section segment 5 being performed via the above-described sliding blocks 11.1 and 11.2, respectively.

A further hollow section segment 5.2 which runs perpendicular to the surface 1 for walking on can extend between the two walls 9 and 10. The inner walls 9 and the outer walls 10 can, as described above, be fixed to it.

Again, it is provided also to make use of the hollow section segment according to the invention for a beam such as is indicated by the reference numeral 5.3. In this way, the entire bridge is constructed using a building-block system with essentially the same elements.

What is claimed is:

1. A bridge, which comprises: a surface for walking on; a handrail adjacent the surface for walking on; at least one of struts and walls, with sliding blocks connected thereto; said at least one of said struts and walls are connected to said surface for walking on wherein the handrail comprises hollow section segments which have at least one longitudinal groove of undercut configuration, said groove connected to said at least one of said struts and walls by means of said sliding block.

2. The bridge according to claim 1, wherein the hollow section segments are extruded aluminum.

3. The bridge according to claim 1, wherein the hollow section segments have a plurality of said grooves on the circumference thereof.

4. The bridge according to claim 1, wherein the hollow section segments are shaped with a round cross section.

5. The bridge according to claim 1, wherein the surface for walking on further comprising additional hollow section segments located under said surface for walking on.

6. The bridge according to claim 1, wherein individual hollow section segments are interconnected in a jointed fashion via joint pieces.

* * * * *